US006712954B1

(12) United States Patent
Pöhler et al.

(10) Patent No.: US 6,712,954 B1
(45) Date of Patent: Mar. 30, 2004

(54) METHOD FOR REPROCESSING WASTE OILS, BASE OILS OBTAINED ACCORDING TO SAID METHOD AND USE THEREOF

(75) Inventors: Joachim Pöhler, Uetze-Dollbergen (DE); Michael Mödler, Helmstedt (DE); Detlev Bruhnke, Braunschweig (DE); Holger Hindenberg, Burgdorf-Ehlershausen (DE)

(73) Assignee: Mineralöl-Raffinerie Dollbergen GmbH, Uetze-Dollbergen (DE)

( * ) Notice: Subject to any disclaimer, the term of this patent is extended or adjusted under 35 U.S.C. 154(b) by 0 days.

(21) Appl. No.: 09/831,104

(22) PCT Filed: Nov. 11, 1999

(86) PCT No.: PCT/EP99/08667

§ 371 (c)(1),
(2), (4) Date: Aug. 13, 2001

(87) PCT Pub. No.: WO00/27957

PCT Pub. Date: May 18, 2000

(30) Foreign Application Priority Data

Nov. 11, 1998 (DE) ..... 198 52 007

(51) Int. Cl.[7] ..... C10M 175/00; C10M 175/02

(52) U.S. Cl. ..... 208/184; 208/179; 208/180; 208/181; 208/186

(58) Field of Search ..... 208/179, 180, 208/181, 184, 186

(56) References Cited

U.S. PATENT DOCUMENTS

| | | | | |
|---|---|---|---|---|
| 4,021,333 A | | 5/1977 | Habiby et al. | 208/179 |
| 4,154,670 A | * | 5/1979 | Forsberg | 208/180 |
| 4,328,092 A | | 5/1982 | Sequeira, Jr. | 208/326 |
| 4,360,420 A | | 11/1982 | Fletcher et al. | 208/184 |
| 4,941,967 A | * | 7/1990 | Mannetje et al. | 208/184 |
| 5,045,179 A | | 9/1991 | Langhoff et al. | 208/262.5 |
| 5,759,385 A | | 6/1998 | Aussillous et al. | 208/187 |

FOREIGN PATENT DOCUMENTS

| | | |
|---|---|---|
| AU | B-33048/84 | 3/1985 |
| CH | 657 867 | 9/1986 |
| EP | 0 109 366 A1 | 5/1984 |
| EP | 0 144 216 A1 | 6/1985 |
| WO | WO 99/13033 | 3/1999 |

* cited by examiner

*Primary Examiner*—Walter D. Griffin
(74) *Attorney, Agent, or Firm*—Fay, Sharpe, Fagan, Minnich & McKee LLP

(57) ABSTRACT

The invention relates to a method for reprocessing waste oils and producing high-grade base oils, whereby waste oil is treated by means of distillation, thin-film evaporation in a high vacuum, optional fractionation for separation into layers of different viscosities and subsequent extraction with N-methyl-2-pyrrolidone and/or N-formylmorpholine. The invention also relates to base oils that can be obtained by said method and to the use thereof. The inventive method is characterized in that approximately any waste oil can be used, including waste oils with polychlorinated biphenylene (PCB) or PCB substitutes with contents of up to 250 mg/kg. Furthermore, waste oils containing up to 5% vegetable oil can be present in the waste oil that is to be reprocessed without impairing the quality of the base oil. The undesirable constituents, especially polycyclic aromatic hydrocarbons and polychlorinated biphenylenes (PCB) or the substitutes thereof are removed in an almost quantitative manner.

10 Claims, No Drawings

METHOD FOR REPROCESSING WASTE OILS, BASE OILS OBTAINED ACCORDING TO SAID METHOD AND USE THEREOF

The present invention relates to a method for reprocessing waste oils, whereby waste oil is treated by means of distillation and extraction method, base oils obtained according to said method and their use thereof.

These days, disposal of waste products is becoming increasingly more important, in particular the elimination of environmentally noxious substances, such as halogenated hydrocarbons, aromatic compounds and similar. These represent acute and latent risks to human health and to other environmental resources, such as water, soil, air, plants and animals. In order to evaluate the actual risk potentials, it is necessary to examine and appraise material compounds and their concentrations. Such data serve as basis for type and scope of the disposal measures that need to be taken.

Of immense interest is hereby the disposal of products burdened with noxious substances, which occur in larger volume, such as waste oils, for example. Disposing these can be done either by elimination of the loaded products or by utilization of same, whereby utilization is basically to be preferred.

Utilization is generally possible via two routes: the product can be materially utilized, i.e., it can be reprocessed, or it can be utilized energetically as fuel. Certain criteria must be observed in such endeavor, which depend upon the product involved and the respective noxious matter burden.

Waste oils, for example, are subject to the so-called Waste Oil Ordinance (AltöIV) of Oct. 27, 1987, which regulates the reprocessing, registration, identification, collection and disposal of waste oils. Waste oils to be reprocessed are, as a rule, prohibited from exceeding a maximal value of 20 ppm of polychlorinated biphenylene (PCB) and a total halogen content of 0.2%. Exceptions, however, are quite possible, depending upon the chosen reprocessing method. Several methods for reprocessing of waste oils or of used oils are known in the state of the art. U.S. Pat. No. 4,021,333 from the year 1977 describes, for example, a method for reprocessing waste or used oils, which includes the following steps:

A) Distillation of the oil for eliminating a prefractionation with a viscosity essentially below that of lubricating oil and a flash point below 121° C., ascertained according to the Tag or Pensky-Martens method;

B) Continued distillation in order to obtain a distillate having, in essence, the viscosity of lubricating oil;

C) Extraction of impurities from the distillate of step B) with an organic, liquid extraction agent, which is essentially non-mixable with the distillate, and D) Segregation from the distillate of the organic solvent and the impurities dissolved therein.

Named as organic extraction agents, are in particular: ethanol, diacetone-alcohol, ethylene-glycol-mono(low-alkyl)ether, diethylene-glycol, diethylene-glycolmono(low-alkyl)ether, o-chlorophenol, furfural, acetone, formic acid, 4-butyrolacetone, low-alkyl-ester of low mono-and dicarbonic acids, dimethylformamide, 2-pyrrolidone and N-(low-alkyl)2-pyrrolidone, epi-chlorohydrin, dioxane, morpholine, low-akyl- and amino(low-alkyl)morpholine, benzonitrile and di-(low-alkyl)sulfoxide and phosphonate. Preferred extraction agents are ethylenglycol-monomethyl-ether, dimethylformamid or N-methyl-2-pyrrolidone. In addition, in step C), 20 to 50 parts by weight of e on agents are employed for 100 parts of weight of obtained distillate from step B).

Distillation is to be performed without fractionating column or similar equipment. It is possible to remove, in a prior step, bothersome components, by means of a thinning agent, in form or an organic solvent, which step, additionally, may be preceded by heating the waste oil with a watery, highly alkaline solution. This method, however, does not always produce satisfactory results with respect to the quality of the reprocessed oils, which contain as before, light loads of noxious substances after the reprocessing.

The present invention is therefore based on the object of further improving the initially described method so that the obtained base oils have the lowest possible load of noxious matter, such as aromatic compounds and specifically polycyclic aromatic hydrocarbons. In addition, design of method control and potential starter materials should be flexible. At the same time, notwithstanding high quality of the obtainable base oils, good yields should be attained.

According to the invention, the above object is solved by a method for reprocessing of waste oils and production of high grade base oils comprising the following steps:

A) Distillation of the waste oil for removal of low-boiling organic fractions, as well as drying of the waste oil by removal of water B) Distillation of waste oil obtained according to step A) under vacuum for separation of fuel oil and diesel fractions, with boiling cut of approximately 170 to 385° C., in form of high-grade heating fuels;

C) Non-destructive distillation of the distillation residue from step B) by means of thin-film evaporation in high vacuum for obtaining a lubricating oil fraction with a standard viscosity range, which may be followed, if needed, by a subsequent distillative fractioning step, possibly under vacuum, which can be divided into boiling fractions of different viscosity states;

D) If applicable, non-destructive distillation of the bottom product from step C) for obtaining a lubricating oil fraction of higher viscosity state from the higher boiling range, which, depending upon requirement, can be divided into a subsequent distillative fractionating step, possibly under vacuum; and E) Extraction of fraction or fractions in the form of lubricating oil fractions or boiling cuts of different viscosity from step C) and, optionally from step D) with N-methyl-2-pyrrolidone (NMP) and/or N-formylmorpholine (NMF) as extracion agent for obtaining extremely high grade base oils, whereby the extraction is undertaken in such manner that undesirable constituents are removed in almost quantitative manner and the contents of polycyclic aromatic hydrocarbons (PAK) and polychlorinated biphenylenes (PCB) respectively, is clearly below 1 mg/kg.

The term "waste oil" in the present invention shall have the meaning of any used semi-liquid or liquid substance, which is comprised in total or in part of mineral oils or synthetic oils, as well as any oil containing residue, including water-oil mixtures or similar. Thus, it is possible to use all waste oils suitable for reprocessing into lubricating oils, in particular used combustion engine and transmission oils, mineral machine oils, turbine oils and hydraulic oils, including their synthetic and semi-synthetic constituents or mineral hydrocarbon basis.

The inventive method for reprocessing said waste oils is described in detail below:

In a first step A), water fractions as well as fractions of low boiling constituents are distilled off, such as fractions of gasoline or solvents. This is preferably done at normal pressure or under light vacuum (up to approximately 600 mbar) at a temperature of approximately 140 to 150° C.

It is possible to facultatively employ in the inventive method, in particularly beneficial manner, a concentrated watery potassium hydroxide solution. Said solution is already employed in this first step in order to avoid, during subsequent distillation steps, additionally burdening generation of the vacuum with water to be separated from the potassium hydroxide solution. The potassium hydroxide solution is preferably highly concentrated, specifically approximately 5 to 50% .

At the same time one obtains, by means of the dehydration process executed in the initial step A), the concentration of the potassium hydroxide as an extremely homogeneously distributed, highly concentrated and therefore highly effective acting reagent for binding acid constituents in the charged waste oil, including extensive demetallization of the charged waste oils. Furthermore, the use of potassium hydroxide solution, which causes formation of specific "soaps", produces in the subsequently described thin film evaporation in step C), a particularly free-flowing and homogenous distillation residue. In contrast thereto, other alkalies, such as sodium compounds described in U.S. Pat. No. 4,021,333, for example, tend to produce precipitations and agglomerations, which can significantly interfere with the further process sequence. By utilizing potassium hydroxide solution it is possible to further improve the purity of the lubricating oil distillates and during the subsequent extraction, additional benefits are obtained with respect to process mode and chemical effect. In addition, by way of this type of alkaline treatment, it is possible to do away with a further step for mechanical separation of solid precipitations.

After separation of water and solvents, the obtained fuel oil and diesel fractions with boiling average of approximately 170 to 385° C. are removed from the waste oil in step B) by distillation in vacuum. The thus obtained residue is subjected, according to step C) to non-destructive thin film evaporation in high vacuum, in which one obtains the lubricating oil fraction proper. For realizing desired viscosity states, the latter can subsequently be fractionated once again.

The residue from the thin film evaporation (bottom product) still contains highly viscous and very valuable lubricating oil constituents which can be obtained in step D) and also fractionated, if applicable, by non-destructive distillation, such as subsequently added second thin film evaporation, with correspondingly higher distillation tempera or lower pressure. Needless to say, step D) is not always necessary, but if used, will improve the yield of base oil and thereby the economic efficiency of the process.

The lubricating oil fractions produced from the above described and (if applicable) fractionating steps (step C) and D)), are subsequently extracted with N-methyl-2pyrrolidone (hereinafter identified as NMP), whereby qualitatively very high grade base oils are obtained for the production of lubricants. N-formylmorpholine (hereinafter identified as NMF) has proven itself as particularly suitable as an alternative extraction medium, under the same conditions and with results comparable to the extraction with NMP. Of course, the lubricating oils or fractions from step C) and D) can, individually, be ether processed or also partially added to each other and then processed further.

Extraction can preferably be done in a column (screen bottom, filling body), preferably with counter-flow process. The use of filling bodies affords high soundness regarding process control and presents benefits relative to potential through-puts (volume flows) and extraction agent distribution of NMP or NMP in the oil. The ratio of NMP/oil or NMF/oil ranges between 0.5 and 2.0 (v/v) depending upon quality requirements of the base oils to be produced.

In contrast to standard practice, the use of NMP and/or NMP as continuous phase, surprisingly, proved detrimental, inasmuch as unstable conditions set in very quickly, inside the column. The extraction agent must therefore be selected as disperse phase.

The extraction can basically be performed within a temperature range of approximately 20 to 90° C.

The process method can be used with employment of a temperature gradient in the column. Temperatures ideally range between approximately 50 to 90° C. at the column head (run off raffinate) and approximately 10 to 50° C. at the column bottom (extraction run off). Higher selectivity regarding the extraction agent is of benefit in this case (for example NMP) with lower temperatures, so that base oil constituents dissolved in the extraction medium are re-dissolved, while the undesirable, to be removed, constituents remain dissolved. As a result, it is possible to attain a significantly higher yield of refined base oil.

Excellent results can also be achieved with a process mode using unchanging temperature over the entire column path (isotherm). The optimal temperature range lies between approximately 50 to 90° C.; depending upon requirements as to yield and quality, other ranges, however, are also possible. This is in contrast to the customary process method of first refining of paraffin-base crude oil distillates, where still high paraffin fictions exist in the components to be extracted, which may already lead to precipitations at lower temperatures (<40° C.), so that extractions must basically be performed at temperatures between 60 to 75° C. In the interest of economic yields, temperatures higher than 75° C. are, in principle, not employed in crude oil distillate extraction. It is, however, possible to compensate for the drawback of isothermal operation in that, vis-a-vis the process variation with temperature gradients, a lower yield is realized, inasmuch as there is no re-dissolution of the raffinate, as already described.

One proceeds as follows: the extraction phase is cooled down and the thereby segregating oil phase with lower extraction medium contents is again put into the oil feed of the column. This can also be called "external feedback".

The NMP and/or NMF existing in the raffinate phase and the extract can be reclaimed in standard method via succeeding distillation processes and returned to the process. As a result of the performed concentration of the potassium hydroxide solution in step A), an alkalinity reserve for extracion is established in the oil feed, which prevents the otherwise partly irreversible formation of acid reaction products of the extraction medium.

According to this method one obtains, as a result, very high-grade base oils, whereby undesirable constituents are removed in an almost quantitative manner, i.e., the contents of polycyclic aromatic hydrocarbons (abbreviated PAK) and of polychlorinated biphenylenes (abbreviated PCB) lies respectively clearly below 1 mg/kg.

The base oils are obtainable according to the above described method are also the object of the invention. Depending upon viscosity state of the distillate fractions produced according to step C) and step D), base oil qualities according to ASTM are obtained with color value between 0.5 and 3.0. The neutralizing figure (abbreviated NZ) as measure of acid residual components in the base oil lies between 0.01 and 0.03 mg/KOH/g.

In contrast to the employed lubricating oil distillates according to step C) or step D), due to the extraction, increase occurs in the viscosity index (abbreviates VI) by 6 to 10 points. It is noteworthy in this respect that the viscosity index of the lubricating oil distillates is clearly higher than that of the usual first raffinate base oils, due to the existing synthetic oil fractions (polyalphaolefins (PAO), hydro-crack oil (HC oils).

By means of the inventive process, the aromatic fraction (abbreviated CA) in the base oil is clearly lowered. In particular, polycyclic aromatic hydrocarbons (PAK) are removed in an almost quantitative manner (sum of PAK according to Grimmer–sum of a specified number of individual substances<1 mg/kg, benzopyrene<<0.1 mg/kg). These are formed in part during utilization of the lubricating oils, in particular during the combustion processes in passenger car/truck engines and they play a significant role due to their health endangering properties, i.e. their cancer causing effect. This is particularly the case with respect to benzopyrene, which is regarded as the principal PAK substance and which was included in the Ordinance of Hazardous Substances (GefStoffV). The contents of these compounds in oil components and oil preparations will clearly be assigned greater significance in future public debate.

Among the currently known methods for reprocessing waste oils into base oils, there is presently no method that is capable of removing the PAK to the extent as it is possible with the method or combinations of the method according to the invention.

Surprisingly, not only are the already earlier mentioned waste oils being considered for reprocessing according to the method, tests have shown that highly contaminated waste oils can also be employed. Thus, it is also possible to reprocess oil burdened with polychlorinated biphenylene RCB) or PCB-substitutes with contents of up to 50 mgf/kg according to DIN 51527-I (Total contents according to LAGA 250 mg/gk [LAGA=Country Working Group Waste]. Polychlorinated biphenylenes are a group of compounds with different toxicities depending upon chlorination contents. They are classified, based on documented suspicion, according to their cancer causing potential (MAK: appendix IIIB), as a result of which segregation of these compounds is required from a toxicological aspect.

Waste oils reprocessed according to the inventive method with the above mentioned PCB contents present a PCB contents in the base oils obtained according to the invention which lies below the detection limits of the analytical method. This is of importance to the extent that both National as well as European regulations with respect to reprocessing of such burdened waste oils will explicitly allow such processes only in individual instances when high qualitative standards are reached for the obtained base oil. The inventive method fulfills these requirements.

In addition, waste oils can also be reprocessed with a content of vegetable oils, so called readily decomposable oils. Up to approximately 5% of such oils can be contained in the waste oil without detrimentally affecting the quality of the base oil.

Needless to say, the obtained base oils have multiple applications, for example as starter products for lubricants or for products in the petrochemical field, inasmuch as—based on the excellent quality—no restrictions exist within the scope of the invention.

The benefits related to the invention are multi-layred. The inventive method is far superior to the state of the art of standard processes of day treatment chemical treatment or hydration, as well as the known distillation methods. The inventive method can be performed without waste, since the extraction media NWP or NMF can be reclaimed and employed again, and the extract is utilized as fuel oil or fuel oil equivalent. In contrast thereto, with the clay treatment method oil contaminated bleached earth remains behind, and with the hydration it becomes necessary to dispose of the spent catalysts, and the reaction gases (H2S, Hcl) need to be rendered harmless.

The energy balance according to the invention specific method is very favorable. It is possible to operate almost without pressure. For overcoming interior fluid friction and pipe line resistances during transport, pressures are only needed in the range of max 5 bar. The maximum temperature range lies at 230° in order to guarantee recuperation of the extraction medium for renewed use. In other processes, raffination effects set in only after temperatures have been reached between 290 and 300° C. (Clay treatment), or it is necessary to employ, in addition, high pressures (hydration: temperatures up to 350° C. and operating pressures between 30 and 200 bar).

The inventive method also affords benefits with respect to operating safety, since the extraction media NNP or NMF are classified as non-toxic (classified as XI: irritating according to Toxic Matter Ordinance, Risk Category A III, WGK 1). With standard hydration methods, on the other hand, hydrogen, being an easily flammable gas, demands high safety requirements. In addition, H2S is formed as a highly toxic gas as well as hydrochloric acid as a highly corrosive gas.

Of special significance is the base oil quality achievable with the invention, as it is obtained via the NMP- or NMP extraction. The base oils have extraordinarily good color value a low neutralizing figure (NZ) and a high viscosity index (VI). As a result of the inventive method, the aromatic fraction in the base oil is clearly reduced. Specifically, polycyclic aromatic hydrocarbons (PAK) are removed in an almost quantitative manner (total PAK according to Grimmer<<1 mg/kg benzopyrene<<0.1 mg./kg). The contents of polychlorinated biphenylene (PCB) also lies below the limit of detection in the obtained base oil.

With respect to the waste oils to be reprocessed, there are almost no restrictions. It is possible to reprocess oil burdened with polychlorinated biphenylene (PCB) or PCB substitute, with contents of up to 50 mg/kg according to DIN 51527-1 (total contents according to LAGA 250 mg/kg). The PCB contents in the base oils obtained according to the invention also lies in this instance below the detection limit of the analytical method, i.e. strict National and European Regulations concerning reprocessing of waste oils are observed. In addition, contents of vegetable, biologically readily decomposable oils of up to 5% may be present in the waste oil to be reprocessed, without resulting in any detrimental influence upon the quality of the base oil. With the state of the art methods, it is impossible to achieve said outstanding quality of the base oil according to the invention. For example, with the bleached earth process, poorer color values are reached, combined with unpleasant odor, a clearly higher NZ, a lower VI, a clearly poorer aging behavior, as well as inadequate removal of polycyclic aromatic hydrocarbons. Hydration methods, do, in fact, offer better yields with lower viscosity index (VI) and otherwise comparable values, but a quantitative removal of polycyclic aromatic hydrocarbons is possible only under extreme hydration conditions and employment of rare metal catalysts, which is not customary in the practice of lubrication/base oil production. Not one of the currently known methods of reprocessing of waste oils into base oils, including the known distillation and extraction methods, is capable of removing the polycyclic aromatic hydrocarbons to the extent as it is possible with the here described method.

In the following, the invention is explained with the aid of examples, which shall not limit the scope of teaching according to the invention. To the person skilled in the art, additional specific embodiments are obvious within the scope of the inventive disclosure.

EXAMPLE 1

Waste oil of category I according to Waste Oil V is distilled, while adding 0.5% of a 50% potassium hydroxide solution, in an apparatus, under vacuum of 600 mbar, in a temperature range of 140° C., for purposes of expelling water and the low boiling constituents.

The obtained dry oil, in a subsequent middle oil distillation is liberated, in in a vacuum of 60 mbar and at a temperature in the sludge of the column of 260° C., from the w middle distillate cut—boiling finish 380° C. The sludge product of the middle oil distillation column reaches a thin film evaporation unit, in which the non-destructive separation takes place, at a vacuum of 3 mbar and thermal carrier oil temperature of 384° C., of charged feed batch, into a lubricating oil distillate mixture and a bottom product. The lubricating oil distillate mixture is separated in a subsequent fractionation into boiling cuts, at process conditions of 80 mbar and 280° C. distillation temperature. The thus obtained boiling cuts in viscosity state, at a viscosity of 40° C. =22 $mm^2/s$ and a viscosity of V40 at 38 $mm^2/s$, are alternately extracted in a succeeding selective raffination with the solvent NM. With a solvent oil ratio of 1.5:1, and an isothermal extraction temperature over the entire column path of 80° C., the employed oil (feed) is transported in counter flow to the utilized solvent NMP. During this process, the undesirable components, among others the polycyclic aromatic hydrocarbons dissolve from the charged feed, resulting, concurrently, in improvement in the quality of the charged lubricating oil distillate.

The raffinate NMP mixture leaving at the head of the column in accordance with the alternating operating mode, is subsequently transmitted to an NMP solvent medium reclaiming device, in order to once again employ said solvent in the process. The attained lubricating oil distillate or lubricating oil raffinate of the respectively employed viscosity category V40, either 20 $mm^2/s$ or 36 mm /s is subsequently used for the formulation of new lubricating oils, such as for example engine oils, transmission oils, hydraulic oils and other applications.

The resulting extract also passes through a solvent reclaiming plant in order to be able to reclaim the solvent NMP present in the extract for another new application. The resulting extract can be utilized as heating fuel oil or a fuel oil diluent in heating oil mixtures.

The bottom product from the thin film evaporation is subjected to a succeeding further thin film evaporation stage with a higher vacuum—0.1 mbar and a temperature of 410° C. During this step there takes place a separation into a highly viscous lubricating oil fraction having a viscosity of 253 $mm^2/s$ and a remaining residue, which is used as heating oil mix-in component, for example as reduction oil in heating oil mixtures for the steel industry. The obtained highly viscous lubricating oil distillate is likewise subjected to extraction with NMP in a succeeding selective raffination, with isothermal reaction conditions in the column at 90° C. and a ratio of solvent: oil of 2:1. One obtains a qualitatively high grade highly viscous raffinate with a viscosity of 217 $mm^2/s$ and an extract which can also serve as mix in material for heating oil components or as heating oil itself for combustions, i.e. as charging material for generating heat or other purposes.

The obtained properties of the reclaimed base oil are as follows:

TABLE 1

| | | Raffinate |
|---|---|---|
| Temperature | [° C.] | 80 isotherm |
| return oil phase from extract | | yes |
| NMP/Oil ratio | v/v | 1.5 |
| Yield | [weight %] | 84 |
| Color ASTM | | 0.5 |
| Neutralizing FIG. | [mg KOH/g] | 0.01 |
| Viscosity 40° C. | [$mm^2/s$] | 20.93 |
| Viscosity 100° C. | [$mm^2/s$] | 4.23 |
| Viscosity Index | | 106 |
| Aromat Percentage CA (IR) | [%] | 3.5 |
| PAK, total n Grimmer | [mg/kg] | 0.257 |
| Benzopyrene | [mg/kg] | 0.0034 |

EXAMPLE 2

The same procedure was followed as in Example 1, with the selected extraction conditions and the attained properties of the reclaimed base oils being represented in the Table below:

TABLE 2

| | | Raffinate |
|---|---|---|
| Temperature | [° C.] | 80 isotherm |
| return oil phase from extract | | yes |
| NMP/Oil ratio | v/v | 1.8 |
| Yield | [weight %] | 85 |
| Color ASTM | | L1.5 |
| Neutralizing FIG. | [mg KOH/g] | <0.03 |
| Viscosity 40° C. | [$mm^2/s$] | 36.05 |
| Viscosity 100° C. | [$mm^2/s$] | 6.07 |
| Viscosity Index | | 114 |
| Aromat Percentage CA (IR) | [%] | 3.9 |
| PAK, total n Grimmer | [mg/kg] | <1 mg |
| Benzopyrene | [mg/kg] | * |

*was not ascertained

EXAMPLE 3 to 5

The same procedure was following as in Example 1, with the selected extraction conditions and the attained properties of the reclaimed base oils being represented in Table 3 below:

TABLE 3

| | | Raffinate | | |
|---|---|---|---|---|
| Temperature | [° C.] | 80 isotherm | 80 isotherm | 80/25 gradient |
| return oil phase from extract | | yes | yes | no |
| NMP/Oil ratio | v/v | 2.0 | 1.1 | 1.1 |
| Yield | [weight %] | 84 | 92 | 92 |
| Color ASTM | | 1.0 | L2.0 | 2.0 |
| Neutralizing FIG. | [mg KOH/g] | <0.01 | 0.03 | 0.04 |
| Viscosity 40° C. | [$mm^2/s$] | 36.00 | 36.44 | 37.03 |
| Viscosity 100° C. | [$mm^2/s$] | 6.08 | 6.07 | 6.10 |
| Viscosity Index | | 116 | 112 | 110 |
| Aromat Percentage CA (IR) | [%] | 3.2 | 4.7 | 4.6 |
| PAK, total n Grimmer | [mg/kg] | 0.024 | 0.553 | 0.078 |
| Benzopyrene | [mg/kg] | 0.002 | 0.020 | 0.005 |

As is apparent from Table 3, it is possible to achieve excellent yields with both inventive process variations, i.e. with isothermal operation or with extraction with temperature gradients. The obtained base oils have, in addition, good color value, low neutralizing figures (NZ) and a high viscosity index (VI). The aromat percentage is in each instance clearly lowered, the contents of polycyclic aromatic hydrocarbons (PAK) lies far below 1 mg/kg and the contents of benzopyrene could be reduced to a range of less than 0.1 mg/kg. The contents of polychlorinated biphenylene (BCP) was below the detection limit of the analytical process. Consequently, the base oils attainable with the invention have an excellent quality

What is claimed is:

1. Method for reprocessing waste oils and production of high-grade base oils, comprising the following steps:

A) distillation of the waste oil for removal of low boiling organic fractions and removal of water, wherein the waste oil to be reprocessed is treated with concentrated aqueous potassium hydroxide solution during the distillation step;

B) distillation under vacuum of the waste oil obtained according to step A) for segregation of fuel oil and diesel fractions with boiling cut of about 170 to 385° C. in form of high grade fuel oils;

C) non-destructive distillation of the distillation residue from step B) by means of thin film evaporation in vacuum to obtain a lubricating oil fraction, which can be separated, as needed, via a subsequent distillative fractioning step, optionally under vacuum, into boiling cuts of different viscosity states;

D) if appropriate, non-destructive distillation of the bottom product from step C) in order to obtain a lubricating oil fraction of higher viscosity state than the fraction obtained in step C) which can be segregated, as needed, optionally under vacuum, by means of a subsequent distillative fractioning step;

E) extraction of the fraction or fractions in the form of lubricating oil fractions or boiling cuts of different viscosity states from step C) and optionally D) with N-methyl-2-pyrrolidone (NMP) and/or N-formylmorpholine (NMF) as extraction medium in order to obtain very high grade base oils.

2. Method according to claim 1, wherein the aqueous potassium hydroxide solution is approximately 5 to 50% by weight potassium hydroxide solution.

3. Method according to claim 2, wherein the feed (charge for extraction) is imparted an alkalinity reserve, to prevent formation of acid reaction products in the extraction medium.

4. Method according to claim 1 wherein the distillation in step A) is performed at normal pressure or at slight under pressure of up to approximately 600 mbar and at a temperature of approximately 140 to 150° C.

5. Method according to claim 1 wherein the extraction is performed in an extraction column, by counter flow process.

6. Method according to claim 1 wherein the extraction is performed in isothermal manner, at a temperature in the range of approximately 90° C.

7. Method according to claim 6, wherein an extract phase is cooled down and a settling oil phase is again added to the feed.

8. Method according to claim 1 wherein the extraction is performed with a temperature gradient, whereby the temperature is adjusted at an extraction column head (run off raffinate) to approximately 50 to 90° C. and at an extraction column end (extract run-off) to approximately 10 to 50° C.

9. Method according to claim 1 herein the waste oil to be reprocessed has a contents of polychlorinated biphenylenes (PCB) or PCB substitutes of up to approximately 250 mg/kg.

10. Method according to claim 1 wherein the waste oil to be reprocessed has a contents of vegetable oils of up to approximately 5%.

* * * * *